United States Patent [19]

Mulvey

[11] 4,175,360

[45] Nov. 27, 1979

[54] COFFERED CEILING SYSTEM

[76] Inventor: Gerard E. Mulvey, 57 Mobile Dr., Toronto, Ontario, Canada

[21] Appl. No.: 793,133

[22] Filed: May 2, 1977

[30] Foreign Application Priority Data

Feb. 25, 1977 [CA] Canada ..... 272724

[51] Int. Cl.[2] ..... B66B 9/00; E04H 6/06

[52] U.S. Cl. ..... 52/28; 52/39; 52/126; 52/484; 362/148; 362/150

[58] Field of Search ..... 362/147, 148, 149, 150; 52/22, 28, 484, 126, 173, 508, 39, 477

[56] References Cited

U.S. PATENT DOCUMENTS

| | | | |
|---|---|---|---|
| 2,616,533 | 11/1952 | Gannett et al. | 52/28 X |
| 2,734,127 | 2/1956 | Naysmith | 362/150 |
| 2,744,716 | 5/1956 | Zingone | 248/318 |
| 2,830,330 | 4/1958 | Heath | 52/484 X |
| 2,854,565 | 9/1958 | Kruger | 362/150 |
| 2,926,237 | 2/1960 | Sorenson | 52/484 X |
| 3,067,323 | 12/1962 | Kember | 52/484 X |
| 3,085,152 | 4/1963 | Schwartz et al. | 52/484 X |
| 3,181,274 | 5/1965 | Izenour | 52/64 X |
| 3,217,155 | 11/1965 | Caferro et al. | 52/484 X |
| 3,402,517 | 9/1968 | Halfaker | 52/126 |
| 3,426,188 | 2/1969 | Baranowski | 52/484 X |
| 3,545,145 | 12/1970 | Yousefpor | 52/28 |
| 3,591,794 | 7/1971 | Dail | 52/28 X |
| 3,636,671 | 1/1972 | Hollister | 52/484 X |
| 3,655,961 | 4/1972 | Hover | 52/28 X |
| 3,685,235 | 8/1972 | Lang | 52/484 X |
| 3,755,667 | 8/1973 | Price | 52/28 X |
| 3,848,385 | 11/1974 | Thompson | 52/28 X |
| 3,848,386 | 11/1974 | Catallozzi | 52/28 X |
| 3,922,073 | 11/1975 | Schwartz | 362/148 X |

FOREIGN PATENT DOCUMENTS

| | | | |
|---|---|---|---|
| 725052 | 11/1966 | Italy | 52/28 |

*Primary Examiner*—Leslie Braun

[57] ABSTRACT

A suspended ceiling comprises a plurality of prefabricated coffer-type modules which are independently and adjustably suspended from the overhead building structure by hanger wires connected to eye-bolts mounted at the corners of the individual modules.

Panels are provided between the modules to effect interconnection thereof and to complete the ceiling structure.

Air handling openings are provided in the module frames and lighting fixtures may be mounted within the modules.

29 Claims, 14 Drawing Figures

COFFERED CEILING SYSTEM

BACKGROUND OF THE INVENTION

The present invention relates generally to ceiling structures and more particularly to suspended ceiling structures. One especially important application of this invention is in the construction of ceiling structures of the type known as coffered. Such coffered ceilings are constructed with a number of recesses, which may be of different shape and in which lighting fixtures can be mounted.

Suspended ceiling structures as presently known are generally installed by erecting a plurality of parallel longitudinal frame members such as T-bars, which are then interconnected by transverse members to form a grid-like structure within which ceiling tiles such as panels, lighting fixtures and air handling facilities are supported.

While such known suspended ceiling structures have presented numerous advantages and have enjoyed considerable commercial success, they do present certain practical disadvantages. This is especially true when it is desired to provide a suspended ceiling structure of the so-called coffered type.

One of the principal disadvantages involved in the installation of such a coffered type ceiling results from the relatively high labour costs involved in such installation. This high labour cost results in part from the relatively slow on-site construction of the individual coffers after erection of the grid-like support and in part from the fact that such installation generally requires labour from three different trades. For example, building tradesmen will first be required to install the supporting grid and to assemble the individual coffers, electricians will be required to install the lighting fixtures and further tradesmen are required to install the air-handling facilities if such facilities are required to be installed, as is generally the case, in such a ceiling structure. This disadvantage is made worse by the fact that the work to be carried out by such different trades must be coordinated throughout the installation of the ceiling structure. Such coordination calls for complex scheduling of the various installation operations to avoid unnecessary labour costs and is, of course, easily upset in the event of any delays relating from labour disputes or otherwise.

Additionally, the known procedure for assembling and installing suspended ceiling structures of the coffered type often involves the use of component parts obtained from different suppliers so increasing the chances of difficulties and delays during the ceiling installation as a result of components not interfitting correctly, not being available when required or having non-matching finishes.

Known suspended ceiling structures and particularly those of the coffered type present a specially serious problem when it is required to install a partition or dividing wall in the space below such a ceiling, particularly if such a partition is to be erected sometime after the installation of the ceiling structure as might be the case if it is desired, for example, to relocate offices within the space below the ceiling. With known coffered ceiling structures, it is often difficult in such a situation to secure such a partition to the existing ceiling without interfering with the existing lighting fixtures and air handling facilities.

It is accordingly a principal object of the present invention to provide an improved suspended ceiling structure and particularly one of the coffered type and which structure presents several practical advantages when compared to the known structures.

More particularly, it is an object of this invention to provide a suspended ceiling structure which can be installed more easily and efficiently than the structures heretofore known and with less risk of undesirable delays resulting from the causes hereinbefore considered.

Other objects of the invention will become apparent as the description herein proceeds.

SUMMARY OF THE INVENTION

Broadly, the present invention resides in the provision of a suspended ceiling structure which comprises a plurality of ceiling modules which are individually suspended from above and which are interconnected along their edges so as then to be disposed in a common ceiling plane.

In the construction of a suspended ceiling structure in accordance with the teaching of this invention, it is possible to prefabricate the individual ceiling modules so that the installation of the ceiling structure simply involves suspending the several modules in their correct positions and interconnecting these modules along their edges.

In accordance with a preferred feature of this invention, the aforementioned modules are usefully prefabricated so as to incorporate support means for lighting fixtures to which such lighting fixtures can readily be attached after the ceiling is erected. The fixtures can then be connected to a previously installed electrical supply system. Air handling openings, provided in the modules can also be connected to air ducts so calling for a lesser degree of co-ordination between the work of different tradesmen. In fact, if the lighting fixtures are provided with conventional electrical cords and plugs, they can be connected by inserting such plugs into previously installed electrical receptacles without requiring the presence of electricians during or after the installation of the ceiling structure.

While this invention is not restricted to the use of any particular arrangement for interconnecting the individually suspended modules, certain advantages are presented if such interconnection is effected using strips or panels which extend between the edges of adjacent panels and which are supported by suitable supporting means provided along such module edges.

The provision of such inter-module panels or strips which will generally and effectively provide an intersecting grid in the ceiling structure facilitates the installation of walls or partitions below the ceiling structure. For example, such a partition can be secured to such a panel itself or, alternatively, such a strip or panel can be removed and the partition then secured to the spaced apart edges of the appropriate modules.

Additionally, it is possible for such a partition to be installed so that it extends upwardly through the ceiling to the building structure so presenting the further advantage of providing an additional fire and sound barrier above the ceiling.

While this invention is not restricted to the use of any particular type of ceiling module, it has been found to be particularly applicable to coffered ceiling structures, in which each module is in the form of a downwardly open box-like structure defined by side walls and a top wall.

Other features of the invention and the advantages presented thereby will become apparent as the description herein proceeds.

BRIEF DESCRIPTION OF THE DRAWINGS

The invention will now be described in greater detail but merely by way of illustration with reference to the accompanying drawings, in which.

DESCRIPTION OF THE PREFERRED EMBODIMENT

Figure 1:
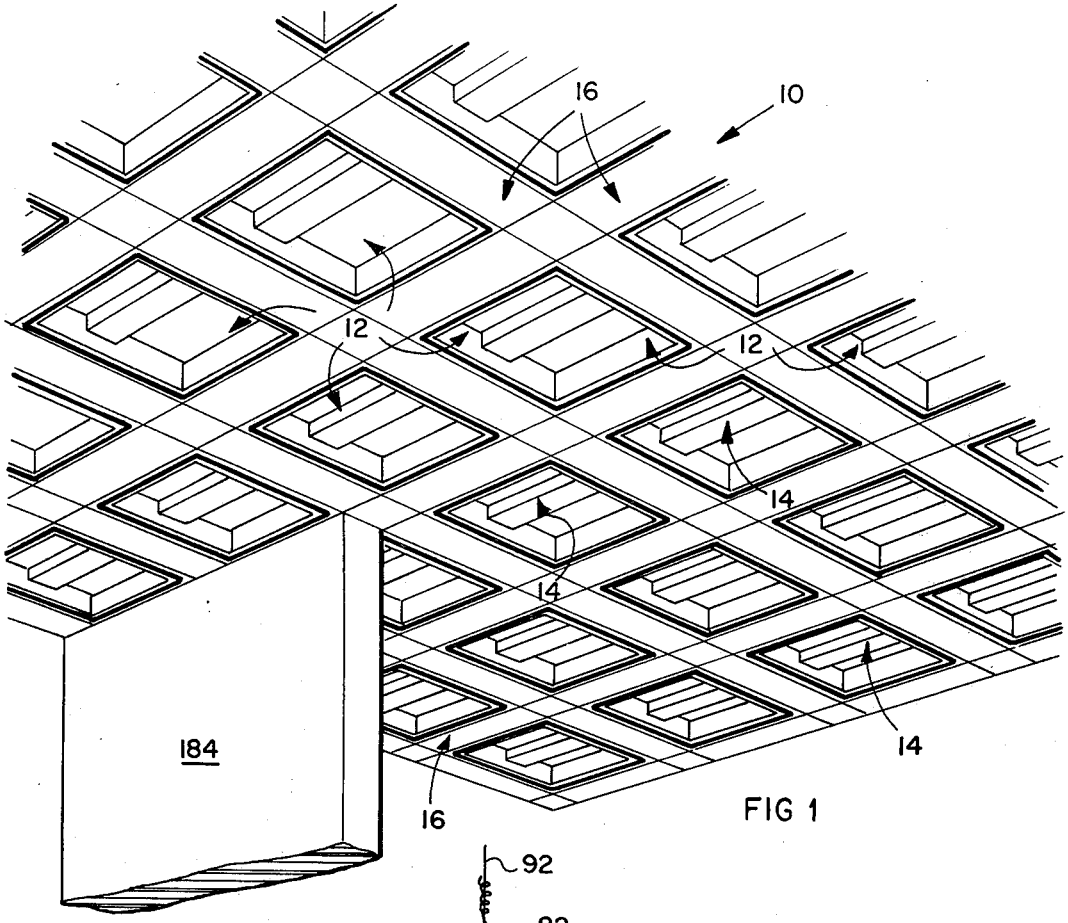
FIG. 1 is a fragmentary perspective view from below of one embodiment of a ceiling structure in accordance with the present invention.

Referring first to FIG. 1 of the accompanying drawings, it will be seen that there is generally indicated therein by the legend 10 a ceiling structure which is formed from a plurality of coffer or ceiling modules indicated generally by the legend 12 and each containing a lighting fixture generally indicated by the legend 14. Supported between the modules 12 in a manner yet to be explained are strips or panels generally indicated at 16.

Figure 2:
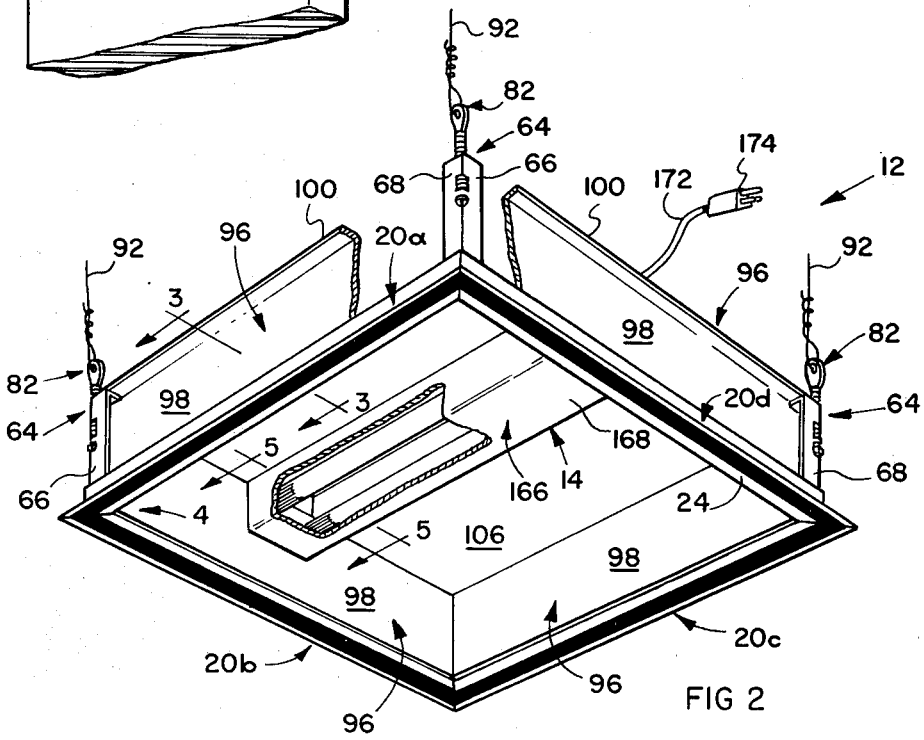
FIG. 2 is a fragmentary perspective view from below of a ceiling module in accordance with this invention and as used in the ceiling structure shown in FIG. 1.
Figure 3:
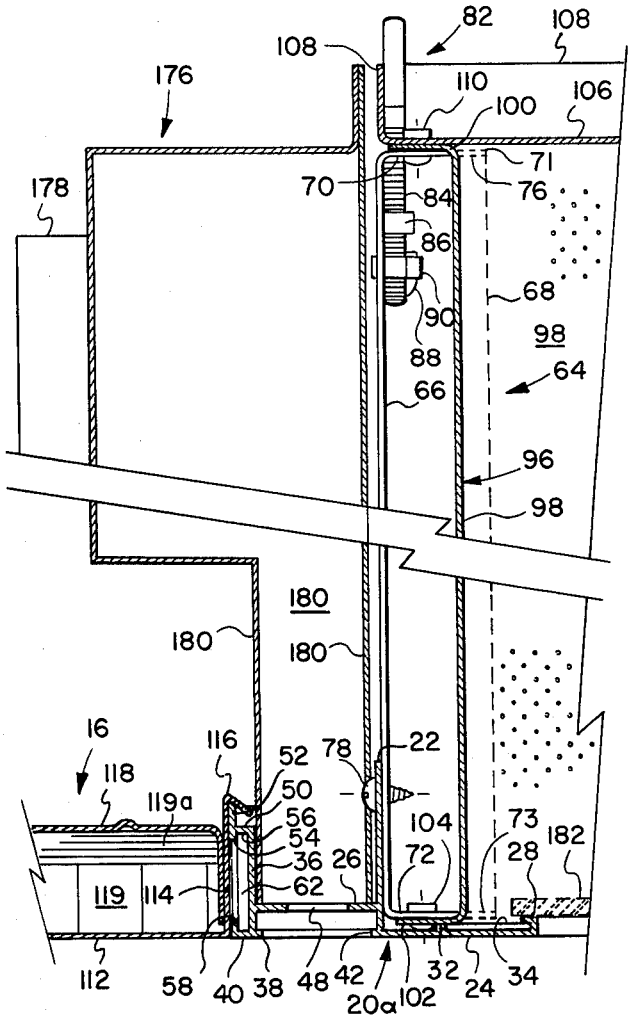
FIG. 3 is a vertical sectional view through the module shown in FIG. 2 when taken as indicated by the arrows 3—3 of that figure.
Figure 4:
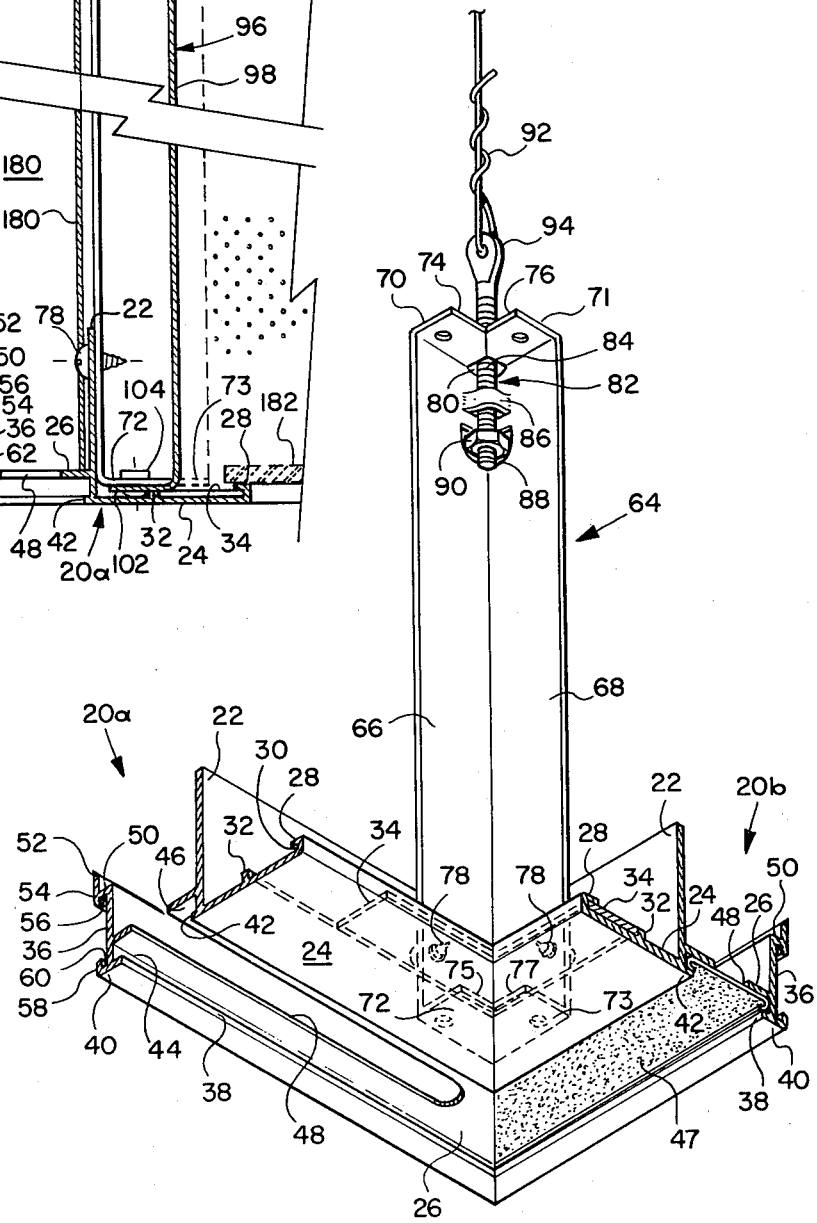
FIG. 4 is a fragmentary internal perspective view of a corner structure of the module shown in FIG. 2 when viewed generally as indicated by the arrow 4 of that figure and with certain parts omitted and others cut away.

Reference will now be made to FIGS. 2, 3 and 4 to describe the construction of the modules 12. While the module 12 is shown in FIG. 2 as having a square configuration in plan view, it should be understood that other rectangular plan configurations are possible. It is also within the scope of this invention to provide and utilize modules having non-rectangular configurations. When used herein and in the claims appended hereto, the word "rectangular" is intended to embrace square structures.

The module 14 comprises, as shown in FIG. 2, a square frame formed from four identical extrusions generally indicated at 20*a*, 20*b*, 20*c* and 20*d*, the ends of which are mitred to interfit as is best shown in FIG. 4. Alternatively, those frame members can be made by roll forming.

Each of the extrusions 20*a*, 20*b*, 20*c* and 20*d* comprises an upstanding flange 22 which is integrally formed with an inwardly directed flange 24 and, at a slightly higher position, with an outwardly directed flange 26. At its inner edge, the inwardly directed flange 24 is formed with an outwardly directed lip 28 defining a recess 30 and, between that inner edge and the upstanding flange 22 with a longitudinally extending lip 32. For interconnecting the extrusions 20*a*, 20*b*, 20*c* and 20*d*, flat L-shaped corner pieces 34 (FIG. 4) are positioned with a respective leg on the flange 24 and with one of the longitudinal edges of such leg abutting the lip 32 and the other longitudinal edge of such leg received in the recess 30.

At its outer edge, the outwardly directed flange 26 is integrally formed with an upstanding flange 36 which, along its lower edge is formed with an inwardly directed lip 38 and an outwardly directed lip 40, the lips 38 and 40 being essentially coplanar with the aforementioned inwardly directed flange 24. A similarly coplanar outwardly directed lip 42 is formed along the bottom edge of the upstanding flange 22, the lip 42 being spaced from the opposed lip 32 as best shown in FIG. 3 and the lips 38 and 42 downwardly defining elongated recesses 44 and 46 respectively.

Elongated openings 48 are formed in the outwardly directed flanges 26 of the frame extrusions 20*a*, 20*b*, 20*c* and 20*d* for the supply of air to the space beneath the ceiling structure 10 or for the removal of air from that space in a manner which will be described in greater detail hereinafter. In the event that it is not required to use such openings 48 for such air flow purposes, such openings can be concealed by an elongated decorative strip 47 which usefully has turned over side edges which are slidingly received in or snapped into the recesses 44 and 46 as shown for the extrusion 20*b* in FIG. 4.

Along its top edge, the aforementioned upstanding flange 36 is formed with an outwardly projecting lip 50 which is itself formed with upwardly and downwardly projecting lips 52 and 54 respectively, the latter defining, with the flange 36, a downwardly open recess 56. An upstanding lip 58 is formed on the outer edge of the lip 40 to define an opposed and upwardly open recess 60, one leg of an L-shaped corner piece 62 (FIG. 3) being inserted with its side edges received in the recesses 56 and 60.

The module 12 also comprises four upstanding corner posts generally indicated at 64, three of which are visible in FIG. 2 and which are formed from lengths of angle iron having flanges 66 and 68. At the upper end, the flanges 66 and 68 of each corner post 64 are folded over at 70 and 71 respectively and mitred to provide horizontal end pieces. Similarly, the lower ends of the flanges 66 and 68 are folded over as indicated at 72 and 73 respectively. These folded over portions 70, 71, 72 and 73 are notched to provide upper and lower edges 74 and 75 respectively parallel to the flange 66 and upper and lower edges 76 and 77 respectively parallel to the flange 68.

The corner posts 64 are secured to adjacent ones of the frame extrusions 20*a*, 20*b*, 20*c* and 20*d* by self-tapping screws 78 passing inwardly through the upstanding flanges 22 of those extrusions and through respective ones of the flanges 66 and 68 of those corner posts.

At its upper end, each of the corner posts 64 is formed in its folded over portions 70 and 72 and at the junction between the flanges 66 and 68 with an opening 80 for freely receiving a vertical and threaded eye-bolt 82, the shaft 84 of which extends through the opening 80 behind a strip 86 stamped from the flanges 66 and 68. A further opening 88 is cut in the flanges 66 and 68 to receive a nut 90 screwed onto the shaft 84 of the eye-bolt 82. A hanger wire 92 (omitted from FIG. 3) suitably anchored at its upper end (not shown) above the ceiling is fastened to an eye 94 of the eye-bolt 82.

It will now be understood that, by turning the nut 90 on the shaft 84 of the eye-bolt 82, the vertical position of the respective corner of the module 12 can be adjusted.

Each of the modules 12 also comprises four side walls generally indicated at 96 (omitted from FIG. 4) and formed from sheet metal so as to have an upstanding wall portion 98 and outwardly directed upper and lower flanges 100 and 102 respectively.

The lower flanges 102 of the side walls 96 are received below the folded over portions 72 and 73 of respective ones of the corner posts 64 with the wall portion 98 abutting a respective one of the edge surfaces 75 and 77. Rivets 104 secure the lower flanges 102 to the lower folded over portions of the corner posts.

The upper flanges 100 of the side walls 96 are disposed over the respective ones of the folded over portions 70 and 71 at the upper ends of the corner posts 64 so that the wall portions 98 abut respective ones of the edge surfaces 74 and 76. Optionally, the wall portions 98 of the side walls 96 are perforated as shown in FIG. 3 and batts (not shown) of a sound-absorbing material such as glass fibre are provided outwardly of the wall portions 98.

The module 12 also comprises a top wall 106 which is formed with upstanding peripheral flanges 108. The top wall 106 is secured to the side walls 96 and to the corner posts 64 by rivets 110 extending through that top wall 106, a respective one of the upper flanges 100 of the side wall, and a respective one of the upper folded over portions 70 and 71 of the corner posts 64. Batts of sound-absorbing material are usefully provided on top of the top walls 106 of the modules 12.

As already indicated, the ceiling structure 10 also comprises strips of panels 16 which are secured to adjacent modules 12 to bridge the gaps therebetween. One such panel is shown fragmentarily in FIG. 3 as being formed from a piece of sheet metal folded so as to provide a lower panel 112 and side walls 114 integrally formed at their upper ends with downwardly projecting lips 116 which are supportingly received over and along the top edges of the aforementioned lips 52 on the extrusions forming the module frame. The panel 16 is also shown in FIG. 3 as being provided with an upper panel 118 spaced apart upwardly of the lower panel 112 to provide a compartment containing a honey comb system of sound entrappment chambers 119, and batts 119*a* lying thereon.

Figure 5:
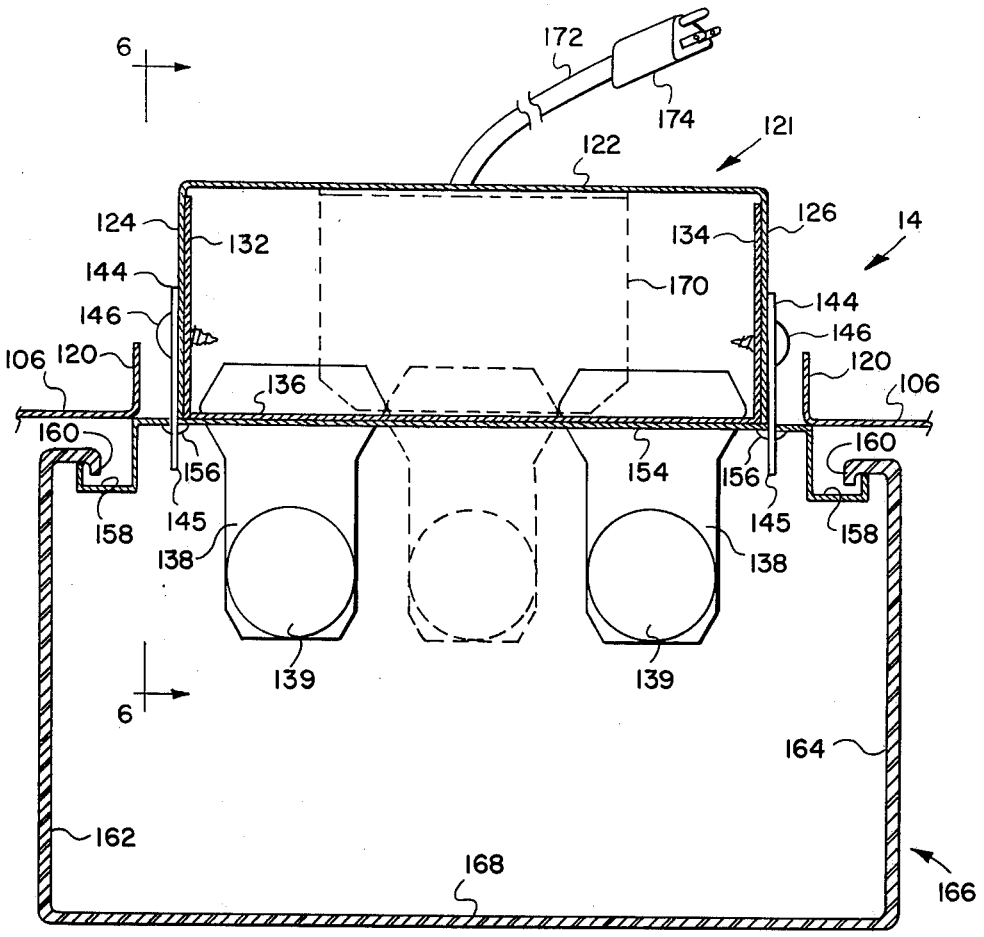
FIG. 5 is a vertical sectional view through the module shown in FIG. 2 when taken as indicated by the arrows 5—5 in that figure.
Figure 6:
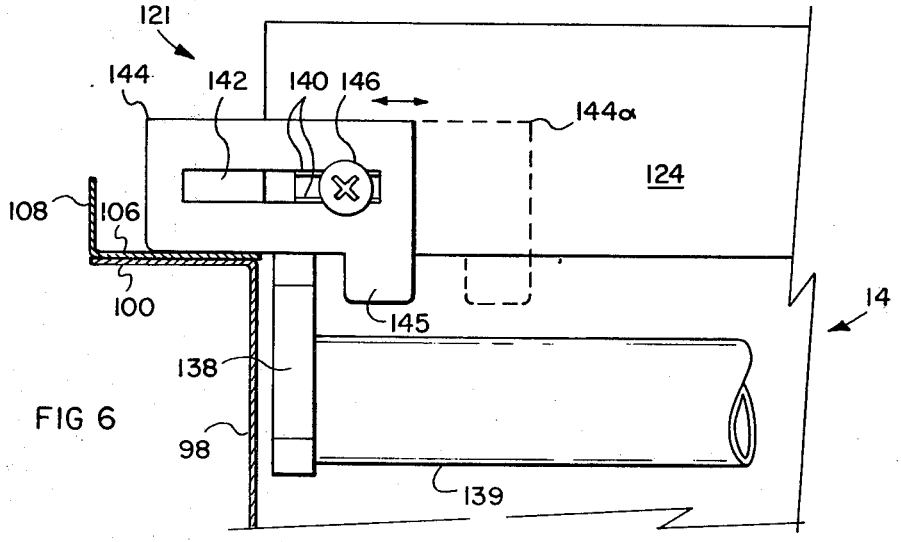
FIG. 6 is a fragmentary vertical sectional view through the module shown in the preceding figures, when taken as indicated by the arrows 6—6 in FIG. 5, and showing details of one system in accordance with this invention for removably supporting a lighting fixture in a ceiling structure.
Figure 7:
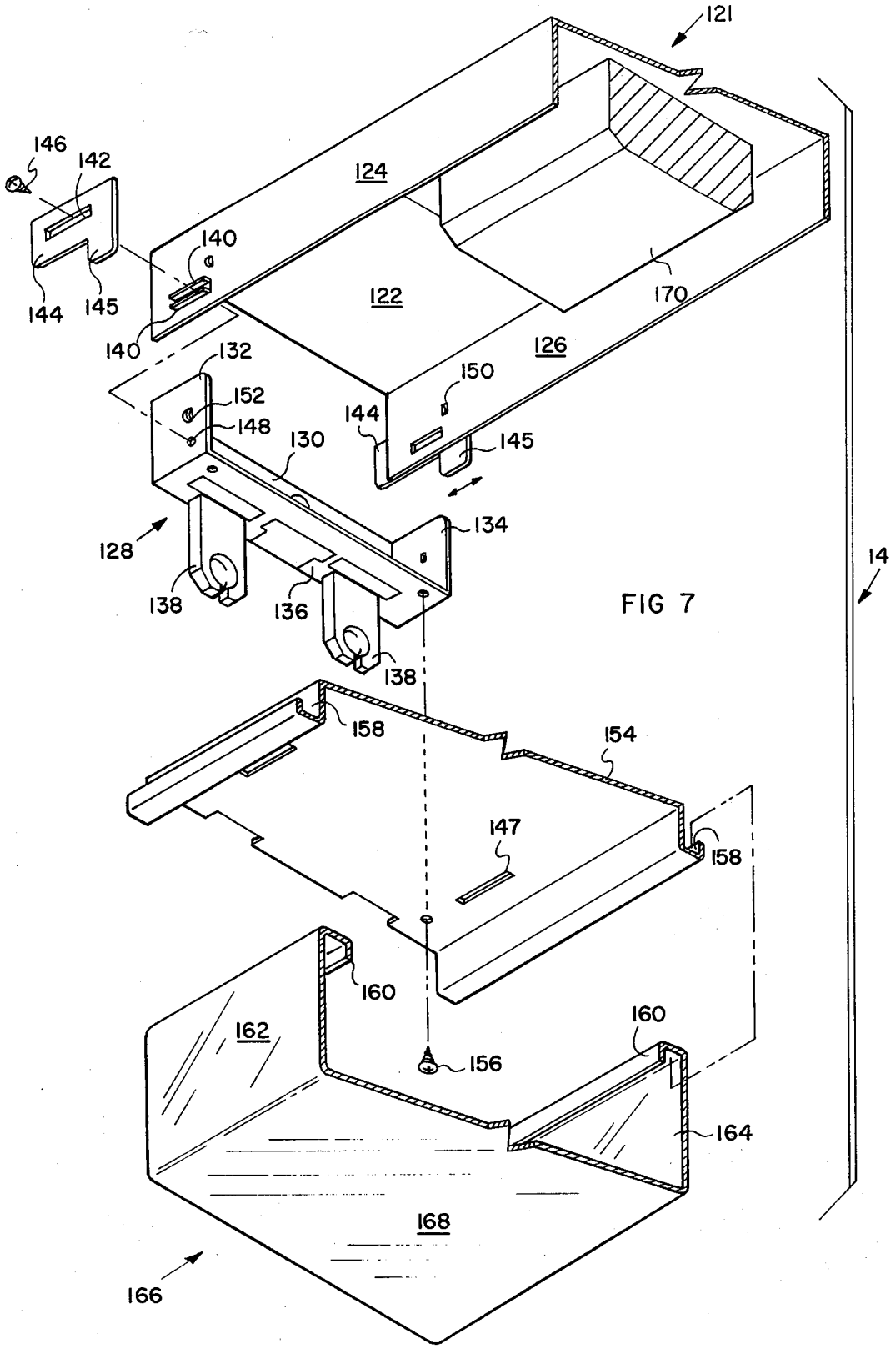
FIG. 7 is a fragmentary, exploded perspective view showing further details of the construction of the lighting fixture shown in the preceding figures.

Reference will now be made to FIGS. 5, 6 and 7 of the accompanying drawings to describe the construction of one of the lighting fixtures 14 and the manner in which that fixture is mounted in an opening provided in the top wall 106 of one of the modules 12. About such an opening, the top wall 106 is deformed to provide an upstanding flange 120 (FIG. 5).

The lighting fixture 14 comprises an upper housing generally indicated at 121 formed from a piece of sheet metal so as to have a top plate 122 and depending side walls 124 and 126. The fixture 14 also comprises two end closures, one of which is shown generally at 128 in FIG. 7 and which is formed by folding a piece of sheet metal to provide an end wall 130, side pieces 132 and 134 and an end base plate 136 on which there can be mounted in a conventional manner one, two or three sockets 138 of a known type for receiving the ends of a fluorescent tube 139.

For a reason yet to be explained, the side walls 124 of the upper housing 121 are each formed near both their ends with outwardly stamped and mutually spaced apart resilient flanges 140 which are slidingly but frictionally received in elongated slots 142 formed in arms 144, also formed with depending handle portions 145. Self-tapping screws 146 extend through the slots 142 in the arms 144, between the flanges 140 in the side walls of the upper housing 121 and into holes 148 provided in respective ones of the side pieces 132 and 134 of the end closure 128 so as to maintain those various components in their assembled configuration as shown in FIGS. 5 and 6. To maintain the end closures 128 in their correct relative rotational positions, the side pieces 132 and 134 thereof normally have tongues lanced therefrom as indicated at 150 for mating engagement with depressions 152 correspondingly formed in the side walls 124 and 126 of the upper housing 121.

The upper housing 121 of the light fixture 14 is completed by a cover plate 154 which is secured to the end base plates 136 of the end closures 128 by screws 156. Along each of its side edges, the cover plate 154 is formed with upwardly open channels 158 for receiving downwardly projecting lips 160 formed along the top edges of side walls 162 and 164 of an integrally formed transparent plastic lens generally indicated at 166 also including a base 168. Slots 147 are formed in the cover plate 154 for receiving the handle 145 of the arms 144.

It will be understood that the lighting fixture 14 will internally be of conventional construction and, for example, will generally include a ballast 170 which will be properly connected to the sockets 139 and to an electrical cord 172 terminating in a conventional electrical plug 174 which can be inserted into a conventional electrical outlet receptacle.

Having described the construction of the lighting fixture 14, the manner in which that fixture is removably mounted in the module 12 will now be explained. For such installation, the arms 144 on the fixture 14 are retracted into the position shown in phantom and indicated at 144*a* in FIG. 6. The upper housing 121 of the fixture 14 is then inserted upwardly through the opening between the upstanding flanges 120 in the top wall 106 of the module 12. The handle portions 145 are then moved longitudinally relative to the upper housing 121 so as to extend arms 144 longitudinally end-wise therefrom and to be supported on the top surface of the top wall 106 of the module 12.

Referring again to FIG. 3, it will be seen that there is shown therein somewhat schematically at 176 a plenum (omitted from FIG. 2) which is supplied with air by a duct 178. The plenum 176 includes walls 180 which extend downwardly between the upstanding flanges 22 and 36 of the extrusion 20*a* so that the air from that plenum can flow through the opening 48 into the space below the ceiling structure 10. Since the plenum 176 itself forms no part of this invention, its construction will not be described in greater detail herein. It should, however, be understood that, while it has been described as being utilized for the supply of air, it can equally be used for the supply of cooled or untreated air or for the extraction of air from the space below the ceiling structure 10.

Having completed the description herein of the construction of the ceiling structure 10, the manner in which the structure is assembled and erected will now be reviewed.

For such assembly, the modules 12 are first individually assembled by first interconnecting the frame extrusions 20*a*, 20*b*, 20*c* and 20*d* using the L-shaped corner pieces 34 and 62. The side walls 96 and the top wall 106 are then fastened to the corner posts 64 by the rivets 104 and 110. Finally, the screws 78 are used to connect the corner posts to the module frame.

The top walls 106 of the modules will have been cut away to receive the lighting fixtures which will be fitted into the modules later.

Having completed the assembly of the modules 12, those modules are then suspended using the hanger wires 92 which are suitably anchored at their upper ends. The heights of the modules 12 may then be adjusted by turning the nuts 90 on the eye-bolts 82. Such height adjustment is usefully carried out by aligning the lower edges of the modules with a laser beam projected across the room in which the ceiling is being installed. The lighting fixtures are then inserted in the manner described above.

During such installation, the plugs 174 on the cords 172 from the lighting fixtures 14 will be inserted into appropriate receptacles (not shown) and the air-flow ductwork and plena will be connected to the modules 12 in the manner already described and in the desired positions. Where the openings 48 are not to be used for air flow, those openings 48 can be concealed by the use of the decorator strips 47 as already explained.

Installation of the ceiling structure 10 is completed by installing the strips or panels 16. Such panel installation is effected by upwardly inserting those panels between the modules and allowing the lips 116 to hook over the top edges of the lips 52 of the module frames in the position shown in FIG. 3.

Having completed the description herein of the installation of the ceiling structure 10, some of the important practical advantages presented by that structure will now be considered.

One very important advantage of the ceiling structure 10 results from the ready removability of the lighting fixtures 14. In the event that one of those lighting fixtures 14 needs to be removed for repair or any other reason, it is a very simple matter to remove it from its module 12. Such removal is effected simply by first removing the lens 166 by flexing its side walls 162 and 164 outwardly to permit the lips 160 to be withdrawn from the channels 158.

The handle portions 145 of the arms 144 at the ends of the lighting fixture 14 are then moved inwardly so as to retract those arms and to allow the upper housing 121 to be lowered through the opening in the top wall 106. The cord plug 174 can then be unplugged from its receptacle. If desired, a replacement lighting fixture 14 can be installed in the reverse manner. It is to be noted that all these operations can be carried out by relatively unskilled labour since no connection and disconnection of individual wires is required.

A further important advantage of the ceiling structure hereinbefore described results from the provision of individual vertical adjustment members in the form of eye-bolts 82 for each of the modules 12. After installation of the ceiling structure 10, settling of the building structure and/or stretching of the hanger wires 92 may nessitate re-levelling of the ceiling structure. Such re-levelling is a relatively simple matter with these novel structures.

Figure 8:
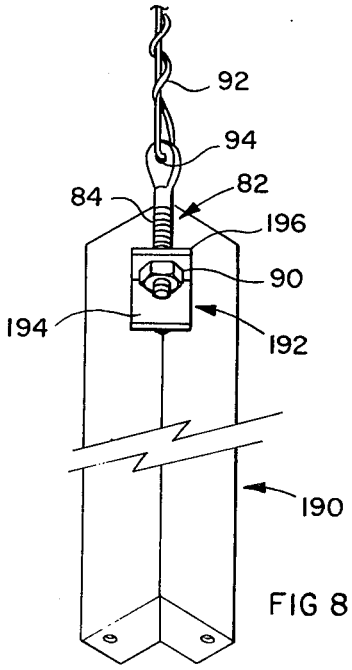
FIG. 8 is a perspective view showing an alternative construction for the corner post of the module shown in FIGS. 2, 3 and 4.

An alternative construction for the corner post of a ceiling module is shown in FIG. 8. The corner post generally indicated at 190 in that figure is generally similar to the post 64 already described herein and differs from the post only in the provision of an angle bracket generally indicated at 192 and including a vertical flange 194 secured, for example, by welding (not shown) to the post 190 and a horizontal flange 196 provided with a hole for receiving the shaft 84 of the eye-bolt 82 as will readily be understood from the drawing.

Another important advantage of the ceiling structure 10 resides in its versatility not only with respect to the various ways in which its appearance can be modified but also with respect to its improved lighting efficiency. It will be readily understood, for example, that one or more lighting fixtures 14 can be installed in each of the modules 12. Alternatively, some of the modules can be left without any lighting fixtures. Additionally, each of the lighting fixtures can be of the single tube or multi-tube type.

Figure 14:
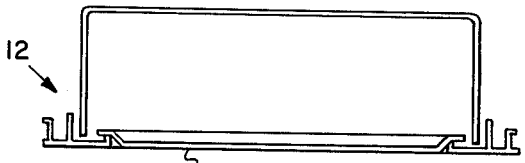
FIG. 14 schematically shows the alternative provision of an opaque panel in the ceiling module of FIGS. 2, 3 and 4.

If desired, a planar lens as indicated fragmentarily and in phantom outline by the legend 182 in FIG. 3 can be provided to provide a different ceiling appearance. Yet another possibility is to provide, instead of the lens 182, an opaque panel 244 in a module 12 as shown in FIG. 14 when no lighting fixture is provided in that module. It is equally possible to provide a lens 182 which has both transparent and opaque portions so as to effectively provide indirect lighting. Yet another possibility when no lighting fixture is to be provided is to use a removable panel to close the opening formed in the top wall 106 of a module 12. Instead of using a planar panel for such purpose, it is also possible to close such an opening with a pan-like structure containing a sound-absorbing batt.

When the lighting fixtures 14 are recessed in the modules 12 as actually shown in the accompanying drawings, all the known advantages in respect of lighting distribution as presented by such arrangements are obtained with none of the known disadvantages of previously known coffered ceilings. For example, time-consuming and expensive on-site construction and assembly operations are avoided by the prefabrication of the modules as is the need for labour from several different trades.

Another important practical advantage presented by the ceiling structures of the present invention results from the absence of structural frame members such as T-bars between the modules 12. Consequently, if, at any time, it is desired to install a partition wall such as that indicated at 184 in FIG. 1, it is necessary only to remove appropriate ones of the panels or strips 16. The partition wall can then be fitted without difficulty and can even be extended upwardly of the ceiling structure 10 to the building structure so facilitating the anchoring of the upper end of such a wall and the provision of a further fire and sound barrier above the ceiling structure 10.

It is also possible temporarily to remove one or more of the modules 12 when required for a different use of the space below the ceiling structure. Such removed modules can, of course, be stored and replaced, if required, at a later date.

While the ceiling structure 10 is shown in FIGS. 1 to 7 of the accompanying drawings as being provided with fluorescent tube lighting fixtures 14, it is equally within the scope of this invention to provide such a ceiling structure with lighting fixtures of other types.

Some possible alternative arrangements will now be described with reference to the somewhat schematic illustrations of FIGS. 9 to 13 of the accompanying drawings.

Figure 9:
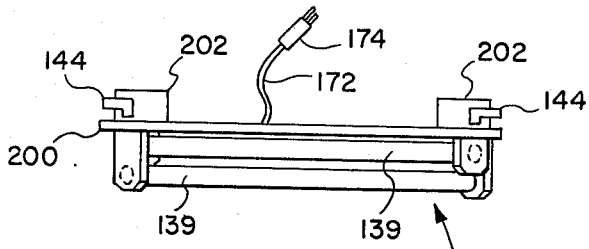
FIGS. 9 to 13 show somewhat schematically alternative arrangements for providing lighting fixtures in the ceiling modules.

The lighting fixture generally indicated at 198 in FIG. 9 comprises a mounting plate 200 below which there are supported two mutually angularly oriented fluorescent tubes 139. The fixture 198 can be removably fitted in the manner already described into an opening in the top wall 106 of a module 12 by means of pairs of retractable arms 144 provided on upstanding flanges 202 at each end of the fixture.

Figure 10:
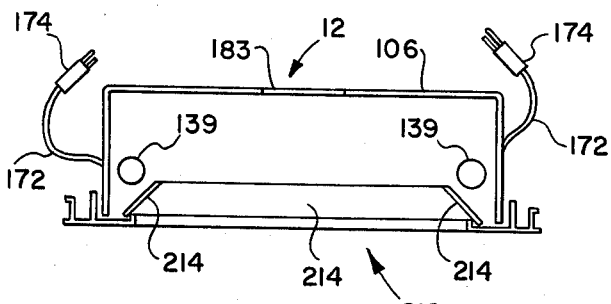

The module structure generally indicated at 212 in FIG. 10 is somewhat different in that the fluorescent tubes 139 are supported in sockets (not shown) provided on opposed side walls of the module 12 so that such tubes then extend generally along the other two side walls of the module. Inwardly and upwardly sloping strips 214 provide a mask to conceal the tubes and to provide a concealed lighting module. Such strips 214 can be permanently or removably attached to the module 12.

Figure 11:
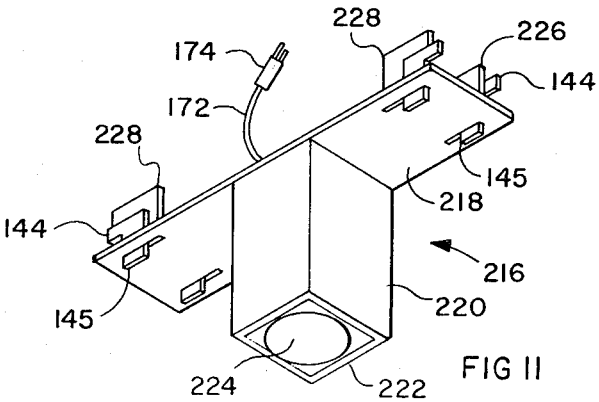

Referring next to FIG. 11, it will be seen that there is shown therein generally at 216 a lighting fixture comprising a mounting plate 218 having depending therefrom a lamp housing including side walls 220 and a bottom wall 222 provided with an opening 224. The fixture 216 is formed on top of its mounting plate 218 at each of its ends with two upstanding flanges 226 and 228 carrying retractable arms 144 for removably securing the fixture in a module 12 in the manner already described. If desired, a transparent lens can be fitted in the aforementioned opening 224.

Figure 12:
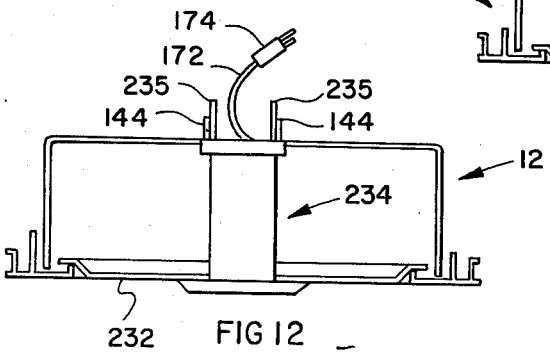

FIG. 12 shows generally at 234 a lighting fixture which is generally similar to the fixture 216 but includes side walls 235 which extend downwardly through a panel 232 supported at the base of the module 12. An elongated lens closes the lower end of the fixture which is removably fitted in the module 12 in the manner already described.

Figure 13:
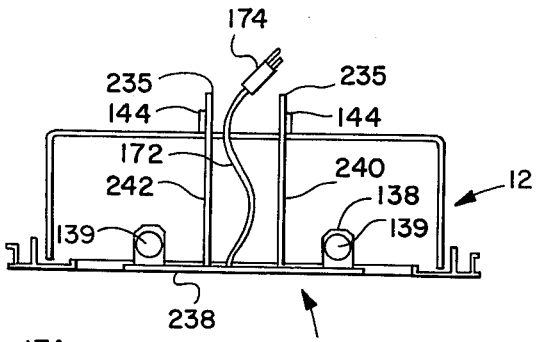

Finally, reference will be made to FIG. 13 which shows generally at 236 yet another indirect lighting fixture. That fixture includes an opaque base plate 238 formed with elongated upstanding flanges 240 and 242 carrying the retractable arms 144 for removably fitting the fixture in a module 12. Fluorescent tubes 139 are mounted above the top surface of the base plate 238 outwardly of the flanges 240 and 242.

All of the lighting fixtures shown in FIGS. 9 and 11 to 13 as well as the module structure 212 shown in FIG. 10 are provided with electrical cores 172 and plugs 174 for the reasons already explained herein with reference to the lighting fixture shown in FIGS. 5, 6 and 7.

The foregoing is a description of a preferred embodiment of the invention which is given here by way of example. The invention is not to be taken as limited to any of the specific features as described, but comprehends all such variations thereof as come within the scope of the appended claims.

The embodiments of the invention in which an exclusive property or privilege is claimed are defined as follows:

1. A suspended ceiling structure closing a ceiling void in a building which comprises a plurality of coffered ceiling modules wherein each ceiling module is adapted to be selectively removably fitted with a lighting fixture whereby the lighting arrangement in said ceiling structure may be varied to provide lighting in some such modules, and no lighting in other such modules, each said module comprising;

upwardly directed side walls, and a horizontal top wall, formed of sound attenuating material, and forming a hollow box-like structure having a downwardly directed open side;

suspension means on each of said modules whereby each said module is independently suspended from above;

ceiling panel support means extending outwardly along the lower edges of said box-like structure whereby ceiling panels are supported between adjacent modules;

unobstructed opening means in said top wall of predetermined length and width communicating with said ceiling void for removably receiving a said lighting fixture therein from below, and said ceiling structure further comprising lighting fixtures of predetermined length and width, dimensioned to fit within said opening means and be removably installed in at least some said opening means from below, any other of said opening means being closed by removable panel means whereby those modules without lighting fixtures will present a finished appearance.

2. A suspended ceiling structure as claimed in claim 1 and in which at least one said module comprises an air flow channel.

3. A suspended ceiling structure as claimed in claim 1 and in which each said module has a rectangular plan configuration.

4. A suspended ceiling structure as claimed in claim 3 and in which each said module comprises a peripheral frame including outward projections constituting said panel supporting means and on which said side walls are upstandingly supported.

5. A suspended ceiling structure as claimed in claim 4 and in which one said module additionally comprises an air flow channel formed through said peripheral frame thereof and adapted upwardly for connection to an air flow duct.

6. A suspended ceiling structure as claimed in claim 4 and which additionally comprises corner posts mounted at the corners of each said module and hangers secured to respective ones of said corner posts and secured at their other ends upwardly of said module.

7. A suspended ceiling structure as claimed in claim 6 and in which each said hanger is secured to an anchor vertically adjustably mounted on a respective one of said corner posts.

8. A suspended ceiling structure as claimed in claim 1 and in which each said module additionally comprises inwardly projecting supporting means for supporting a planar member between said side walls and downwardly of said top wall thereof.

9. A suspended ceiling structure as claimed in claim 1 and in which said lighting fixture comprises supporting arms secured thereto and projecting therefrom for supported disposition on parts of said top wall.

10. A suspended ceiling structure as claimed in claim 9 and in which said arms are retractably mounted on said lighting fixture.

11. A coffered ceiling module for the construction of a composite ceiling structure, without the erection of an integral supporting frame work, said module comprising;

a rectangular open sided box-like structure having side walls and a top wall formed of sound attenuating material;

a rectangular frame around the lower edges of said side walls;

panel support means extending outwardly from said frame for supporting ceiling panels between adjacent modules;

corner posts attached to and extending upwardly from said frame at the intersection of adjacent side walls;

adjustable suspension means on said corner posts whereby a said module can be suspended and levelled independently of other said modules, with said frames of two adjacent modules supporting a ceiling panel therebetween, and, unobstructed opening means in said top wall of predetermined length and width communicating with said ceiling void for removably receiving lighting fixture means therein from below, said lighting fixture means being of predetermined length and width and being removably insertable into said opening means from below.

12. A coffered ceiling module as claimed in claim 11 and in which an air flow opening is formed in said generally rectangular frame.

13. A coffered ceiling module as claimed in claim 11 wherein each said corner post defines an L-shaped section having two vertical faces, normal to one another, and wherein adjacent ends of said side walls are enclosed within said faces.

14. A coffered ceiling module as claimed in claim 13 including a threaded adjustment member rotatably mounted on each said corner post, located between said vertical faces and said ends of said side walls, and opening means in said post for access to said adjustment member.

15. A coffered ceiling module as claimed in claim 11 wherein said side walls comprise flat planar wall panels having upper and lower edges, and flange members on said upper and lower edges, directed outwardly with respect to the interior of said box-like structure.

16. A coffered ceiling module as claimed in claim 11 including inward support means around the lower edges of said walls.

17. A coffered ceiling module as claimed in claim 16 including translucent lens means releasably interengageable with said inward support means whereby to provide lens surfaces substantially in the plane of said ceiling panel support means.

18. A coffered ceiling module as claimed in claim 11 wherein said lighting fixture means extends downwardly through the interior of said box-like structure and including a baffle plate attached thereto defining an open space therearound, and said lighting element means being mounted behind said baffle plate within said box-like structure.

19. A coffered ceiling module as claimed in claim 11 wherein said lighting fixture means comprises a planar panel adapted to fit in said opening means, and fastening means for fastening same in position and housing means attached thereto and depending downwardly within said module and said lighting element means being mounted therein.

20. A coffered ceiling module for the construction of a composite ceiling structure having ceiling panels in a lower plane, and rectangular coffered recesses formed therein terminating in a higher plane, said module comprising;

a rectangular open sided box-like structure having side walls and a top wall, all said walls being directly visible from beneath the ceiling structure, and being finished to provide a decorative aesthetic appearance;

ceiling panel supporting means around the lower edges of said side walls for supporting said panels in said lower plane;

suspension means attached to each said box-like structure for independently suspending same in position from above;

unobstructed opening means in said top wall of predetermined length and width communicating with said ceiling void for removably receiving lighting fixture means therein from below;

lighting fixture means of predetermined length and width removably insertable into said opening means from below;

lighting element means depending from said lighting fixture means extending below the plane of said top wall, but above the plane of said ceiling panel supporting means, whereby light from said element means will directly illuminate said top wall and said side walls and render the same visible thereby providing pools of light beneath said modules, and, lens means releasably attachable to said lighting fixture means enclosing said lighting element means on three sides without extending over said top wall, whereby said top wall remains visible around said lens means and is directly illuminated by light passing through said lens means.

21. A coffered ceiling module as claimed in claim 20 wherein said top wall defines a rectangular opening therethrough, said lighting fixture means having a rectangular shape corresponding thereto and releasable attachment means on said fixture means, for attaching same in position.

22. A coffered ceiling module as claimed in claim 20 wherein said lighting fixture means includes downwardly extending lens attachment means lying below the plane of said top wall, and said lens means having interlockable formations attachable thereto whereby said lens means may be releasably attached from below said top wall, without removal of said lighting fixture means.

23. A coffered ceiling module as claimed in claim 20 wherein said lens means comprises a bottom wall and two side walls, enclosing said dependent lighting fixture means on three sides whereby light therefrom may be emitted around an arc of at least 270° to provide direct illumination within said module.

24. A coffered ceiling module as claimed in claim 20 wherein said lighting fixture means includes supporting arm members rectractably mounted thereon for movement into and out of supporting engagement with said box-like structure, and operable from below.

25. A coffered ceiling module for the construction of a composite ceiling structure having ceiling panels in a lower plane, and rectangular coffered recesses formed therein terminating in a higher plane, said module comprising;

a rectangular open sided box-like structure having four side walls meeting at corners and a top wall, all said walls being directly visible from beneath the ceiling structure and being finished to provide a decorative aesthetic appearance;

outer support means on the lower edges of said side walls for supporting ceiling panels in said lower plane between said modules;

inner support means on the lower edges of said walls, in the same plane as said outer support means;

corner posts attached to said side walls at said corners;

adjustable suspension means attached to said corner posts for independently suspending said module in position from above;

unobstructed opening means in said top wall of predetermined length and width communicating with said ceiling void for removably receiving lighting fixture means therein from below, said lighting fixture means being of predetermined length and width and being removably insertable into said opening means from below;

panel means of predetermined length and width dimensioned to be removably installed in said opening means, and, closure means dimensioned to fit within said inner support means and at least partially close off said box-like structure from below.

26. A coffered ceiling module as claimed in claim 25 wherein said closure means defines a central opening and including lighting fixture means mounted in said box-like structure concealed behind said closure means.

27. A coffered ceiling module as claimed in claim 25 wherein said closure means has a central opening, and including lighting fixture means extending through said central opening.

28. A coffered ceiling module as claimed in claim 25 wherein said closure member completely closes off said box-like structure.

29. A coffered ceiling module as claimed in claim 25 including lighting fixture means attached to said panel means and extending downwardly therefrom in said box-like structure.

* * * * *